US006770129B1

(12) United States Patent
Brown et al.

(10) Patent No.: US 6,770,129 B1
(45) Date of Patent: Aug. 3, 2004

(54) COATING COMPOSITIONS FOR PAPER

(75) Inventors: David W. Brown, Ambler, PA (US); Kenneth Breindel, Lansdale, PA (US); Ronald W. Broadbent, Horsham, PA (US); Michael S. Wiggins, Lansdale, PA (US)

(73) Assignee: Cognis Corporation, Ambler, PA (US)

( * ) Notice: Subject to any disclaimer, the term of this patent is extended or adjusted under 35 U.S.C. 154(b) by 0 days.

(21) Appl. No.: 10/352,530

(22) Filed: Jan. 28, 2003

Related U.S. Application Data

(60) Provisional application No. 60/352,732, filed on Jan. 29, 2002.

(51) Int. Cl.[7] ..... C09D 7/06; C09D 7/12; D21H 17/71

(52) U.S. Cl. ..... 106/287.22; 106/150.2; 106/154.11; 106/154.3; 106/155.1; 106/155.2; 106/209.1; 106/213.1; 106/214.1; 106/214.2; 106/271; 106/287.17; 106/287.22; 106/287.23; 106/287.25; 106/287.28; 162/172; 162/174; 162/175; 162/158

(58) Field of Search ..... 106/150.2, 154.11, 106/154.3, 155.1, 155.2, 209.1, 213.1, 214.1, 214.2, 271, 287.17, 287.22, 287.23, 287.25, 287.28; 162/172, 174, 175, 158

(56) References Cited

U.S. PATENT DOCUMENTS 5,827,453 A 10/1998 Gross et al.
5,895,605 A 4/1999 Gross et al.
6,110,977 A 8/2000 Gross et al.
6,387,962 B1 5/2002 Wiggins et al.
6,509,395 B2 * 1/2003 Breindel et al. ..... 523/400
6,576,736 B2 * 6/2003 Wiggins et al. ..... 528/29
6,583,185 B2 * 6/2003 Wiggins et al. ..... 516/134

* cited by examiner

*Primary Examiner*—David Brunsman
(74) *Attorney, Agent, or Firm*—Aaron R. Ettelman

(57) ABSTRACT

Aqueous paper coating compositions containing at least one of a clay, a starch, casein, a resin, and a wax; and wherein the composition contains from about 0.001% to about 5% by weight of at least one base-catalyzed branched reaction product comprising the following reactants:

A) at least one compound of formula I $$R^1(X)_3 \quad \text{(I)}$$

wherein each X group is a halogen atom or one X group is a halogen atom and two X groups represent an epoxy oxygen atom, which is attached to two adjacent carbon atoms in the $R^1$ group to form an epoxy group, and $R^1$ is an alkanetriyl group containing from 3 to 10 carbon atoms; and B) at least one compound having the formula II $$R^2X(AO)_nY \quad \text{(II)}$$

wherein $R^2$ is a substituted or unsubstituted, saturated or unsaturated, organic group having from 1 to 36 carbon atoms; X is —O—, —S—, or —$NR^3$— where $R^3$ is hydrogen or a $C_1$–$C_{18}$ alkyl group; each AO group is independently an ethyleneoxy, 1,2-propyleneoxy, or 1,2-butyleneoxy group, n is a number from 0 to 200; and Y is hydrogen, or Y can be a mercapto group or an amino group (amino or $C_1$–$C_6$ alkylamino group) in place of a terminal —OH group, provided that when Y is mercapto or an amino group, n is at least 1;

wherein the mole ratio of the linking compound A) to B) is from 0.1:1 to 5:1.

41 Claims, No Drawings

COATING COMPOSITIONS FOR PAPER

CROSS REFERENCE TO RELATED APPLICATION

This application claims the benefit of copending provisional application Ser. No. 60/352,732, filed on Jan. 29, 2002.

FIELD OF THE INVENTION

This invention relates to compositions for coating paper, hardboard, fiberboard, paperboard, and molded-pulp products.

SUMMARY OF THE INVENTION

The present invention relates to compositions for coating paper and related pulp-based products. The compositions of the invention are aqueous compositions, usually in the form of suspensions comprising at least one of the following: a clay, a starch, casein, a resin, and a wax, and containing one or more of a branched reaction product comprising the following reactants:

A) at least one compound of formula I $$R^1(X)_3 \quad \text{(I)}$$

wherein each X group is a halogen atom or one X group is a halogen atom and two X groups represent an epoxy oxygen atom, which is attached to two adjacent carbon atoms in the $R^1$ group to form an epoxy group, and $R^1$ is an alkanetriyl group containing from 3 to 10 carbon atoms; and B) at least one compound having the formula II $$R^2X(AO)_nY \quad \text{(II)}$$

wherein $R^2$ is a substituted or unsubstituted, saturated or unsaturated, organic group having from 1 to 36 carbon atoms; X is —O—, —S—, or —$NR^3$— where $R^3$ is hydrogen or a $C_1$–$C_{18}$ alkyl group; each AO group is independently an ethyleneoxy, 1,2-propyleneoxy, or 1,2-butyleneoxy group, n is a number of from 0 to 200, preferably from 1 to 100, more preferably from 2 to 20; and Y is hydrogen, or Y can be a mercapto group or an amino group (amino or $C_1$–$C_6$ alkylamino group) in place of a terminal —OH group, provided that when Y is mercapto or an amino group or a $C_1$–$C_6$ alkylamino group, n is at least 1;

wherein the mole ratio of the linking compound A) to B) is from 0.1:1 to 5:1, preferably from 0.6:1 to 2:1, more preferably from 0.8:1 to 2:1 and most preferably from 0.8:1 to 1.5:1.

Paper coating compositions containing one or more of the above reaction products results in the minimization or elimination of fisheyes, excellent flow and leveling properties, and marked reduction or elimination of foam. In addition, coating open time is extended without affecting either wet strength of the paper or its gloss when dry.

DETAILED DESCRIPTION OF THE INVENTION

Other than in the operating examples, or where otherwise indicated, all numbers expressing quantities of ingredients or reaction conditions used herein are to be understood as modified in all instances by the term "about".

When the term "paper products" is used herein, it is to be understood to include paper itself, hardboard, fiberboard, paperboard, and molded-pulp products.

Over 90% of paper products are made from wood pulp containing fibers from 0.5 to 3 mm long. However, hemp ropes and esparto grass are sometimes used, and some specialty high-grade papers are made from rags and clothes. The compositions of the invention can be used to coat all of the above.

Wood is a cellular substance chemically composed of about 70% holocellulose, 25% lignin, and 5% water and ethyl alcohol-benzene soluble extractives. The above percentages are based on oven-dry wood.

The chemical composition and physical character of wood vary from species to species, within species grown in different geographical locations, and within a given tree, depending upon the location of the fiber cell in the tree. Both lignin (noncarbohydrate) and holocellulose (carbohydrate) are polymeric substances. Holocellulose is composed of approximately 70% alpha cellulose and 30% hemicellulose, the long-chained alpha cellulose being characterized by nonsolubility in alkali; whereas the shorter-chained hemicellulose is alkali-soluble, the degree depending upon the alkali concentration. Lignin concentration in wood substance is greatest in the middle lamella (the zone around each individual fiber cell), decreasing in concentration through the cross section of the fiber, and reaching a concentration of about 12% at the inner layer of the fiber adjacent to the fiber cavity, or lumen. It is the middle-lamella material (lignin and hemicellulose) that cements the fiber cells together, thus giving rigidity to the fibrous wood structure.

The objective of wood pulping is to separate the cellulose fibers one from another in a manner that preserves the inherent fiber strength while removing as much of the lignin, extractives, and hemicellulose materials as required by pulp end-use considerations. Wood pulp to be used for the manufacture of hardboard, for example, requires only the removal of water-soluble wood sugars and sufficient fiberization, i.e., separation of fibers, to permit effective felting of the fibers in a sheet-forming operation. In a subsequent operation in which the felted fiber sheet is subjected to high pressure and heat, the lignin in the fiber mass softens and flows, ultimately acting as a bonding agent cementing the fibers together into a coherent hardboard.

Wood is converted to pulp by mechanical and chemical actions which constitute the pulping process. Their selection depends upon the type of wood supply available and the pulp qualities desired. Pulps can be characterized on the basis of the unbleached pulp yields achieved by the pulping process used, i.e., the yield of oven-dry (OD) pulp obtained from oven-dry debarked wood. Pulp yield is a direct indication of degree of chemical action (delignification and chemical attack on carbohydrate and other nonligneous material). There are degrees of defibration effected by chemical and mechanical action utilized to produce the pulp. For example, in producing a full chemical pulp, wood chips are subjected to chemical action (digestion or cooking) in a pressure vessel; when digestion is completed, the cooked and softened chips retain the same physical form as the raw chips originally charged to the digester, but separate into essentially discrete fibers as a result of mechanical action occurring upon sudden release of the chips from the pressure vessel into a receiving tank, which ordinarily is at atmospheric pressure.

At the other extreme, no chemicals are used in the production of mechanical pulp, and defibration is effected by subjecting wood to a mechanical grinding or attrition action. In this instance, the defibration is aided by some small degree of chemical change and solubilization of wood substance occasioned by heat generated by the grinding operation.

The above pulps are unbleached and are produced by processes called pulping processes. In many instances, these pulps must be further treated chemically to remove residual lignin, hemicellulose, and color bodies before they can be considered suitable for use in specific applications. This further treatment is called bleaching, and the bleaching operation is actually an extension of the pulping process.

Customarily, pulping processes and bleaching processes are considered separately, although the choice of bleaching process is highly dependent upon the pulping process used. The pulping processes that are briefly described hereinafter pertain only to the production of unbleached pulps.

The soda, kraft, and sulfite pulping processes are used to prepare full chemical pulps. The soda process, which uses sodium hydroxide as the cooking chemical for delignification purposes, has largely been superseded by the kraft process, which is characterized by its use of sodium hydroxide and sodium sulfide as active delignification agents in the chip-cooking phase of the process.

Chip-digestion parameters are digester pressure and temperature, digestion time to and at maximum temperature, amount of active alkali used per unit weight of OD wood (percent active alkali), percentage ratio of sulfide to active alkali (percent sulfidity), and weight ratio of cooking liquor (including chip moisture) to OD wood weight. No two kraft pulp mills use the same set of parameter values. Such values must be frequently adjusted, even within a given mill because of variations in incoming wood and pulp-quality requirements.

Kraft processes are applicable to nearly all species of wood, and effective means of recovering spent cooking chemicals for recycle in the process have been developed. Some sodium and sulfur losses do occur and are replenished in the cooking-liquor system by adding sodium sulfate at the recovery boiler, where it is converted to sodium carbonate and sulfide. In order to maintain a proper sulfur-to-sodium ratio in the recovered chemicals, other chemicals, such as sodium carbonate, sodium sulfite, and sulfur, are sometimes used for chemical makeup.

In contrast to the highly alkaline (pH 11–13) kraft processes, sulfite pulping processes are acidic in nature and are of two general types: (1) the acid sulfate processes utilize calcium, sodium, magnesium, or ammonium bisulfite in combination with free or excess sulfur dioxide as cooking chemicals (pH 1.7–2.3); (2) the bisulfite processes use sodium, magnesium, or ammonium bisulfite (pH 3.5–5.5) for chip digestion.

Several sulfite processes are multistage and use various combination of acid sulfite and bisulfite cooking stages and can even use the alkaline kraft cook as one of the multistages. Although spent calcium acid sulfite cooking liquor can be incinerated, there is no recovery of calcium or sulfur. The sodium and magnesium bases can be recovered with or without sulfur recovery, and spent ammonium base liquor can be burned with recovery of sulfur as an option.

High-yield chemical pulps can be produced by the soda, kraft, or sulfite process in which chemical use and digestion time and/or temperature are suitably reduced to effect a milder cook than used for full chemical pulps. Mechanical defibrators are used to complete the separation of wood fibers not accomplished by the chemical action.

Semichemical pulps are usually prepared by the neutral sulfite semichemical (NSSC) process, although modifications of the full chemical processes can be used. Active pulping chemicals are (in the sodium-base NSSC process) sodium sulfite buffered with sodium bicarbonate (pH 7.0–9.0) and (in the ammonium-base NSSC process) ammonium sulfite with ammonium hydroxide used as a buffer. Defiberization is usually accomplished by attrition mills of the disk type. Mechanical pulps are produced by two basic processes: (1) stone groundwood pulp (SGW) is produced by the defibration action of natural or artificial grindstones rotated at moderate speeds (200–300 rpm) against bark-free bolts of roundwood axially aligned across the peripheral face of the stone on the presence of water. By air-pressurization of the grinder, a pressurized groundwood pulp (PGW) of improved quality can be produced. (2) Refiner mechanical pulp (RMP) is produced by the attriation action upon raw wood chips of an open (atmospheric) discharge disk refiner. By preheating the chips in a pressurized vessel via direct steaming at a temperature of 120° C. or higher and fiberizing the heated chips in either a pressurized or atmospheric disk refiner, thermomechanical pulp (TMP) is produced.

Chemimechanical pulps (CMP) are produced by processes in which groundwood or chips are treated with weak solutions of pulping chemicals, such as sulfur dioxide, sodium sulfite, sodium bisulfite or sodium hydrosulfite, followed by mechanical defibration. By presteaming chemically treated chips before attrition, chemithermomechanical pulps (CTMP) are produced. The mild chemical action, augmented by heat, softens wood lignin and promotes easier defibering with less fiber damage than achieved by the purely mechanical processes.

Batch digesters are vertical, stationary, cylindrical pressure vessels into which chips and cooking liquor are charged under atmospheric conditions. Heating of the digester, after sealing of the feed ports, is effected by direct steam addition or by continual withdrawal of liquor through screened ports and reintroduction of the liquor, after passage through external heat exchangers, onto the top (and sometimes into the bottom) of the chip mass within the vessel. Often, a combination of the direct and indirect heating methods is used. Modem batch digesters are typically 4000–6000 cubic feet (113–170 cubic meters) in volume, with height-to-diameter ratios of 3.5–5.5, and precook pulp capacities of 10–20 tons (9–18 metric tons).

Continuous digesters have been developed as part of the highly successful effort to convert pulp and papermaking from a series of strictly batch operations into an integrated series of continuous operations. A number of successful types of continuous digesters range from horizontal and inclined tube (single or multiple) designs, in which the chip charge is moved through the digester by mechanical screw or bucket conveyors, to vertical digesters, in which chip movement is effected by gravity.

Screened chips are conveyed from storage to a chip-supply bin in the digester house. If hardwood and softwood chips are to be cooked together, they are blended by weight proportion during this transfer. Chips feed by gravity from the bin to a chip meter, either a twin-screw or a multipocket rotary feeder, the speed of which determines chip and cooking-liquor flow rate to the digester and pulp discharge rate.

Metered chips drop to a low-pressure rotary feeder valve, through which the chips are introduced into a steaming vessel maintained at a pressure of about 15 pounds/square inch gage (2.2 kPa), where the chips are preheated, air is expelled from the chip interior, and chip moisture content is leveled in preparation for impregnation with cooking liquor. Since cooked chips are continually being removed from the bottom of the digester, chips pass downward in the digester, replacing those discharged; time of passage through the cooking zone is normally 90–120 minutes. As cooked chips reach the bottom zone of the digester, they are plowed to a central well in the bottom of the digester while being mixed with filtrate from the pulp washer for cooling. Mechanical forces exerted in the transfer of chips from the digester to the blow tank effect fiberization of the chips, the degree of which depends upon cooking conditions. The fibrous material collected in the blow tank is called pulp and separate blow tanks are normally used to collect the several types of pulp produced alternately in the digester.

Pulp (brown stock) discharged to the blow tank is in admixture with black liquor, a water solution of spent and residual cooking chemicals and dissolved wood substance, and is at a consistency of 10–18%. The term consistency has a meaning peculiar to the pulp and paper industry and refers to the percentage ratio of washed, dry (either oven- or air-dried) fiber to total fiber slurry weight. The fiber bundles left in the pulp after blowing must be fiberized, i.e., separated into discrete fibers, and the black liquor removed in order for the pulp to be refined (a conditioning of individual fibers) and formed into a fiber sheet on the lineboard machines.

Pulp is diluted with filtrate from the pulp washer to a consistency of about 4.5% in the lower portion of the blow tank and fed to fibrilizers, which serve the purposes of metal trapping, fiber-bundle breaking, rough screening, and pumping.

Refining is accomplished by disk mills, equipped with different plate designs or patterns than those used for defibration. During the refining operation, cellulose fibrils, which wind spirally around the fiber at various positions in its cell wall, are loosened, the cell wall swells due to water absorption, and the fiber conditioned for sheet formation and interfiber binding in the paper- or board-making operation.

During the pulping operations various substances are or can be added, such as fillers (mainly clay and chalk) to make the paper opaque, sizes e.g. rosin and alum for water resistance, and dyes and pigments.

Modern paper machines begin with a flow spreader or distributor, in which a dilute fiber suspension, usually 0.1 to 1% fibers, are conveyed to a headbox which delivers a jet of the suspension or slurry through a slice (sluice) across the full width of the machine, almost 400 inches in some large machines. In the headbox, the fibers are dispersed, and the flow is rectified as well as possible so that the jet is delivered onto a moving, endless, end-mesh wire screen with uniform composition, flow rate, and velocity. The pressure in the headbox and its slice opening are adjusted so that the jet velocity matches the speed of the wire screen, which may be up to 4000 feet per minute for newsprint. The proper stock flow per unit width corresponds to the desired basis weight of the paper. (Basis weight is weight per unit area and varies with grades and sizes of papers).

The dispersion of fibers in the headbox is brought about by subjecting the slurry or suspension to shear stresses, usually with turbulence. Various designs have been developed to accomplish this.

The most common type of paper machine is the Fourdrinier, in which the moving wire screen is in the form of an endless conveyor belt stretched between two large rolls. The roll situated under the headbox slice is called the breast roll. The roll located generally at the end of the straight wire run is the couch roll. Drainage of the slurry through the wire screen is induced by several types of driving forces. In the early, slow-speed machines, the principal force was gravity. Later, the hydrodynamic action of table rolls, which support the wire and rotate with it, began to play an important part in drainage as speed increased. More recently, foils came into use, i.e., rigid, stationary, hydrodynamically shaped elements which support the wire and exert a pumping action through the wire screen. Other means are perforated or slotted boxes with vacuum over which the wire runs. When only water is drained, they are called wet boxes. When applied toward the dry end of the wire screen, they also draw air through the wet paper mat and are called suction boxes. Other equipment configurations have been developed to meet these objectives. On all modern Fourdriniers, a forming board located close to the breast roll is used to scrape off water, drained initially by gravity, from the bottom of the wire.

A relatively recent and important development in paper forming is the twin-wire former (Beloit Bel Baie Former), in this type of machine, the fiber suspension is confined between two wire screens, and water is removed through both wires either simultaneously or alternately. This two-sided drainage leads to greater symmetry of distribution of fines and other nonfibrous particles through the thickness of the sheet. A significant feature of twin-wire forming is the elimination of the free surface of the fiber-water suspension while the sheet is being formed. This greatly reduces the large-scale disturbances (waves, streaks, and jumps) which occur at higher speeds on Fourdrinier wires.

Not all the fiber and other solid materials are retained by the forming wire. For this reason and because so much water is used in the papermaking process, the white water removed in the sheet-forming process is recirculated in the overall system. A large part of it is added directly to the high consistency stock and fed back to the headbox, while a small portion goes into a save-all device, which recovers much of the solids from the white water. These extracted fibers and other solids are returned and added to the suspension. The clarified water is used in showers for cleaning wires and felts and other purposes so that only a small amount of the reused water eventually is discharged.

At the end of the forming system, the paper web is transferred from the wire to a press felt, a fine-textured, usually synthetic fabric. At this point, the web contains about 4 or 5 parts water to 1 part solids. The wet paper web and one or more press felts pass through two or more press-roll nips, where water is squeezed out. Pressing also compacts the paper mat. This increases the potential interfiber contact areas where bonds will be formed.

The early plain press used a pair of metal and rubber-covered solid rolls. The expressed water had to flow out of the nip in the upstream direction, parallel to the paper web, as in an old washing-machine wringer. Nip pressures were then limited by the damage to the wet web (crushing) caused by this lateral flow. Although the plain press was improved in many ways, later development work led to the fabric press in which the felt contacting rolls are wrapped with a relatively coarse and incompressible mesh fabric. In another development (Beloit Ventanip press), the felt contacting rolls have narrow, closely spaced circumferential grooves. In both types, the lateral flow is virtually eliminated.

While the development of the modem presses has achieved high performance with simple constructions, the remaining problems of flow resistance and web rewetting leave room for improvement. It is generally recognized that mechanical removal of water is much less costly than drying.

After water removal by pressing has been done to the extent which is practical with present technology, the paper web leaves the press section with 1.5–2 parts of water to 1 part fibers. Most of the remaining water down to 5–10% must be removed by evaporative drying. In the most common method, the paper web is passed over a series of staggered cast-iron drums internally heated by condensing steam at pressures ranging up to approximately 10.2 atmospheres. The paper web is held in contact with the rotating drums by means of dryer felts or fabrics under tension. The diameter of the dryer drums is typically 5–6 feet. There may be as many as 100 of them in heavyweight paperboard machines.

Ventilating devices which blow air of controlled temperature and humidity through the dryer felts into the spaces between adjacent dryers are used. Here the air is confined by the sheet and felt runs. These pocket ventilating systems, together with greater control of the flow patterns within the dryer hood (which usually encloses the entire drier section) have led to significant improvements in cross-machine uniformity of paper drying. This results in paper and board of improved suitability for modern high-speed converting and printing operations.

Other types of dryers, including radiant heating, dielectric and microwave heating, and high-velocity, hot air impingement, have been developed. These devices are generally applied to drying coated paper where sheet contact to a solid surface may be detrimental during drying. Wider application has been limited because of low thermal efficiencies and high capital costs.

Many printing grades of paper and paperboard are coated with an aqueous suspension of pigments (such as clay) in adhesives (such as starch) to provide a smoother surface, control the penetration of inks, and improve the pick resistance, appearance, brightness, and opacity. These and other materials are also applied, such as functional coatings, to provide such features as water resistance, pressure sensitivity for carbonless copying, and a wide variety of other properties. The appropriate materials may be added to the papermaking furnish during some stage of stock penetration (called internal sizing). Application of sizing or coating to one or both surfaces of the formed and dried sheet, rather than as internal sizing, simplifies the sheet-forming process and provides better control of surface properties.

The principal methods of surface coating may be classified as roll coater, trailing blade, and air-knife coating, according to the method used to apply and control the final coating-layer thickness and smoothness. A recently developed coater (Beloit Billblade) simultaneously coats and smooths both surfaces of the paper web by running it down through the nip between a blade and a roll while maintaining two puddles, one between the web and the roll and the other between the flexible blade and the web, thus eliminating the necessity for two coating stations.

After sizing or coating, the solvent, usually water, must be removed from the coating by evaporative drying. With some coating formulations and paper grades, drying can be done on ordinary steam-heated drums without damage to the coated surface, particularly if the surface of the first drum is smooth (sometimes chrome plated). However, it is often desirable to do the initial drying with air impingement or radiant heating. Surface coating can be done on the machine as a step in the paper-machine operation.

Nearly all paper grades are calendered after they have been dried to the desired final moisture content. Ordinary calendering involves passing the paper web through one or more nips between metal rolls with high linear pressures. The calendering process flattens out the paper structure by virtue of the high pressure and "irons" the sheet. Calendering causes bulk reduction, which often is not desired, and surface smoothing, which is desired. The results strongly depend upon moisture content, calender-roll temperature, roll pressure, and speed.

In supercalendering, an off-machine operation, the calender rolls consist of alternating chilled-steel and paper-filled rolls, i.e., paper disks clamped on a steel shaft. These roll fillers have to be replaced periodically. Very high pressures are used. The increased pressure and shear forces associated with deformation of the relatively soft paper roll and the very high roll pressures impart a smoother, glossier surface to the web than ordinary calendering with all-metal rolls. This type of calendering is frequently used on coated sheets to provide a glossy coated surface.

There are other process configurations for the various coating effects and specifications desired.

Although the Fourdrinier machine is used for making almost all grades of paper and board, other designs are sometimes more advantageous. The cylinder machine, invented at about the same time as the Fourdrinier, consists of a rotating cylindrical mold covered with a wire screen and partially submerged in a vat. The stock flows into the vat, and a mat is formed on the cylinder under a hydraulic head difference between the stock level in the vat and the white-water level inside the cylinder. The wet mat is picked up by a felt running through the nip between a couch roll and the cylinder. The cylinder machine is used for making multi-ply board, employing several vats in series. Because of slow speed and other limitations, the cylinder machine is becoming obsolete. In recent years, several new types of machines have emerged.

The coating compositions of the invention, which can be used in the coating methods described above, are aqueous suspensions containing at least one of and usually a combination of, a clay, a starch, casein, a resin such as rosin, and a wax, and from 0.001 to 5% by weight, preferably from 0.1 to 3% by weight of at least one branched reaction product described above. Generally, the aqueous coating compositions contain at least a clay, a starch, and a resin, together with the branched reaction product.

The quantities and selection of the above components often present in the aqueous paper coating compositions, i.e. clays, starches, casein, resins, waxes, and the like are not critical, and can vary in both number and quantity depending on the paper product being manufactured. The selection of these components and their quantities can be readily determined by those skilled in the art for any particular paper product.

The clays used in the compositions are known as paper clays, which give body, weight and finish to the paper. Whiteness of color, plasticity, and freedom from sand are characteristics of these clays. The best paper clays come from England and Georgia.

The starch used in the compositions is preferably, but not necessarily, corn starch, which acts as an adhesive.

The resin is usually rosin which helps make the coating water resistant.

As discussed above, the branched reaction product of the invention provides a number of unexpected benefits for the paper coating composition and to the paper products to which it is applied, e.g. a minimization or elimination of fisheyes on the coated paper product, excellent flow and leveling properties when the composition is applied to the surface or surfaces of the paper product, marked reduction or elimination of foam in the coating composition, both in the composition when formulated and stored, and also when applied to the paper product, and an extension of coating open time without affecting either the wet strength of the paper or its gloss when dry.

In the branched reaction products used in the paper coating compositions of the invention, the linking compound of formula I in component A is preferably epichlorohydrin or another epihalohydrin. However, trihaloalkanes can be used, such as 1,2,3-trichloropropane, 1,2,4-trichlorobutane, 1,3,6-trichlorohexane, and the like. Instead of chlorine in the epihalohydrins and trihaloalkanes, the corresponding bromine and iodine compounds can also be used, including compounds containing two or even all three of the above halogens.

The component B) compounds of formula II are organic (optionally alkoxylated) alcohols or the corresponding sulfhydryl or amine compounds.

The $R^2$ group can be a substituted or unsubstituted, saturated or unsaturated hydrocarbon group having from 1 to 36 carbon atoms. Examples of such hydrocarbon groups include linear or branched alkyl groups having from 1 to 36 carbon atoms, preferably from 4 to 22 carbon atoms, linear or branched alkenyl or alkynyl groups having from 2 to 36 carbon atoms, preferably from 4 to 22 carbon atoms, aryl groups having from 6 to 22 carbon atoms, e.g. phenyl, tolyl, naphthyl, and other polycyclic aromatic groups, and arenyl groups having from 7 to 36 carbon atoms. Arenyl groups are alkyl-substituted aromatic radicals having a free valence at an alkyl carbon atom such as a benzylic group.

The $R^2$ group can also be a saturated carbocyclic group, an unsaturated carbocyclic group having one or more multiple bonds, a saturated heterocyclic group, or an unsaturated heterocyclic group having one or more multiple bonds, e.g. piperidino, morpholino, thiomorpholino, pyrrolidino, and the like. Any of the above $R^2$ groups can be substituted groups, i.e. the substituent groups can be single or multiple substituents such as a sulfur functionality such as a mercaptan or thio group; a nitrogen functionality such as an amine or amide functionality; an alcohol functionality, a silicon functionality, e.g., a siloxane; an ether functionality, e.g. a $C_1$–$C_6$ alkoxy group; or any combination thereof.

The $R^2$ group in formula II is preferably a branched chain alkyl group containing from 4 to 36 carbon atoms, preferably from 4 to 12 carbon atoms, and more preferably from 8 to 10 carbon atoms.

When the X group of formula II is an —S— group, the $R^2$ group will preferably have from about 4 to about 22 carbon atoms, examples of which include but are not limited to, dodecyl mercapto and 1-hexadecanethio.

When the $R^2$X-group of formula II is a secondary or tertiary amino group, the group preferably contains from 4 to 22 carbon atoms, and n is preferably a number of from 1 to 50. Examples of primary and secondary amines useful for obtaining the $R^2$X-group include, but are not limited to, dibutyl amine, cyclohexyl amine, isodecyl amine, and dioctylamine.

Optionally an additional component C) can be reacted with the linking agent of formula I and the compound of formula II. A glycidyl ether or amine can be added to the reaction of formula I and formula II. The amount of the glycidyl ether or glycidyl amine is from about 1 to about 20 mole percent based on the moles of the compounds of formula II used in the reaction. When the glycidyl ether or glycidyl amine is added, the ratio of component A) plus the glycidyl ether or glycidyl amine to component B) is preferably from about 1.2:1 to about 5:1. Examples of glycidyl ether include, but are not limited to, PEG 600 diglycidyl ether, TETRONIC™ 701 tetraglycidyl ether, triglycidyl di or triethanolamine, polyoxyethylene (POE) 200 tallow amine diglycidyl ether, propoxylated (POP10) trimethylol propane triglycidyl ether, propoxylated (POP7) pentaerythritol tetraglycidyl ether. Examples of glycidyl amines include, but are not limited to, tetraglycidyl 1,6-hexane diamine, tetraglycidyl JEFFAMINE™ EDR-148, and tetraglycidyl isophorone diamine.

When Y in formula II is an amine or sulfhydryl group, the resulting compounds can be readily prepared from the corresponding alcohols wherein the terminal hydroxy group is replaced by an —SH group or by an amine nitrogen. For example, a compound of formula II where Y is —OH can be subjected to a catalyzed ammoniation (with ammonia, or a lower alkylamine) for replacement of the hydroxyl, or to a capping of the hydroxyl with epichlorohydrin followed by ammoniation (with ammonia, or a lower alkylamine) of the resulting glycidyl group.

In the compounds of formula II, the AO groups when present are preferably all ethyleneoxy groups. However, as stated above, each OA group can be independently an ethyleneoxy (EO), 1,2-propyleneoxy (PO), or 1,2-butyleneoxy (BO) group, i.e. any one or more of such groups can be present, and they can be present in any order, as well as be present in blocks, e.g. compounds of formula III:

$$R^2O(EO)_m(PO)_p(BO)_qH \quad \text{(III)}$$

wherein $R^2$ has the meaning given above, m is a number of from 0 to 100, preferably from 1 to 50, p is a number of from 0 to 50, e.g. from 1 to 50, and q is a number of from 0 to 50, e.g. from 1 to 50. Compounds of formula III in which $R^2$ is a branched chain alkyl group having from 4 to 12 carbon atoms, m is a number of from 2 to 20, and p and q are 0 are preferred.

The degree of hydrophilic and hydrophobic properties of the reaction products of components A) and B) can be readily controlled by controlling the type and number of alkyleneoxy groups in component B). For example, the greater the number of ethyleneoxy groups present, the greater the water solubility, while the presence of 1,2-propyleneoxy groups and/or 1,2-butyleneoxy groups for example, will decrease water solubility.

In general, the compounds of formula III wherein the sum of n, m, and p is at least 1, and especially at least 2 are preferred for use herein.

The branched reaction products used in the practice of the invention can be prepared by reacting components A) and B) (and C if present) together, preferably in the presence of an inert organic solvent, preferably a solvent such as toluene that will azeotrope water, and in the presence of an inorganic base such as an alkali metal hydroxide, e.g. aqueous sodium hydroxide or potassium hydroxide, at a temperature in the range of from 60 to 125° C. In a preferred embodiment of the process, component B) is first mixed with the base, and the organic solvent, if present, and water is removed, e.g. by azeotropic distillation. Then component A) (and C, if present) is slowly added and the reaction continued until the reaction is completed. The reaction mixture is filtered and the filtrate vacuum stripped to remove any organic solvent.

Inert organic solvents that can be used in the above process are nonmiscible with water and nonhydroxylic. Examples of such solvents include toluene, $CHCl_3$, $CH_2Cl_2$, chlorobenzene, acetonitrile, and petroleum ethers, preferably toluene.

This invention will be illustrated but not limited by the following examples.

EXAMPLES

Example 1

Preparation of the Reaction Product of Decyl Alcohol·4EO and Epichlorohydrin About 150 grams of decyl alcohol ethoxylated with an average of 4 moles of ethylene oxide (0.45 OH equivalents) were mixed with 385 grams of toluene and 54 grams of 50% aq. NaOH (0.675 equivalents). The water was removed by azeotropic distillation and when a moisture level of less than 0.8% was reached, about 46 grams (0.51 equivalents) of epichlorohydrin were slowly added. This mixture was allowed to react at 100°–110° C. for 24 hours. An aliquot of this mixture was removed and filtered to remove the NaCl and vacuum stripped to remove the toluene to give an amber, easily pourable liquid product that was dispersible in water.

Example 2

20 grams of the reaction product of Example 1 is added to 10 kilograms of an aqueous suspension containing 500 grams of paper clay, 200 grams of cornstarch, and 100 grams of rosin. The resulting low-foaming suspension is then applied by roll coater to paper prepared from a full chemical pine wood pulp by the Kraft process. The coated paper is then dried and calendered. The resulting coated paper is substantially free from fisheyes, has a smooth uniform coating, and good wet strength and gloss.

Example 3

Preparation of the Reaction Product of Octyl Alcohol·4EO and Epichlorohydrin About 200.0 gm (0.654 hydroxyl equivs.) of octyl alcohol ethoxylated with an average of 4 moles of ethylene oxide was mixed with 400 gm toluene and 78.4 gm (0.98 equivs.) of 50% NaOH. Water was removed by azeotropic distillation until the level was below 0.8%. The mixture was cooled to 80° C. and 67.2 gm (0.72 moles) of epichlorohydrin was added over 45 mins. The mixture was stirred for 24 hrs at 110° C. until the epoxy titration showed no epoxide left. The material was cooled, filtered and the toluene was removed by vacuum distillation leaving a dark brown low viscosity liquid.

Example 4

100 grams of the reaction product of Example 3 is added to 10 kilograms of an aqueous suspension containing 600 grams of paper clay, 150 grams of cornstarch, and 100 grams of rosin. The resulting low-foaming suspension is then applied by roll coater to paper prepared from a full chemical spruce wood pulp by the Kraft process. The coated paper is then dried and calendered. The resulting coated paper is substantially free from fisheyes, has a smooth uniform coating, and good wet strength and gloss.

What is claimed is:

1. In an aqueous paper coating composition comprising at least one of a clay, a starch, casein, a resin, and a wax, the improvement wherein the composition contains from about 0.001% to about 5% by weight of at least one base-catalyzed branched reaction product comprising the following reactants:

A) at least one compound of formula I $$R^1(X)_3 \quad \text{(I)}$$

wherein each X group is a halogen atom or one X group is a halogen atom and two X groups represent an epoxy oxygen atom, which is attached to two adjacent carbon atoms in the $R^1$ group to form an epoxy group, and $R^1$ is an alkanetriyl group containing from 3 to 10 carbon atoms; and B) at least one compound having the formula II $$R^2X(AO)_nY \quad \text{(II)}$$

wherein $R^2$ is a substituted or unsubstituted, saturated or unsaturated, organic group having from 1 to 36 carbon atoms; X is —O—, —S—, or —$NR^3$— where $R^3$ is hydrogen or a $C_1$–$C_{18}$ alkyl group; each AO group is independently an ethyleneoxy, 1,2-propyleneoxy, or 1,2-butyleneoxy group, n is a number from 0 to 200; and Y is hydrogen, or Y can be a mercapto group or an amino group or a $C_1$–$C_6$ alkylamino group in place of a terminal —OH group, provided that when Y is mercapto or an amino group, n is at least 1;

wherein the mole ratio of the linking compound A) to B) is from 0.1:1 to 5:1.

2. The composition of claim 1 wherein said mole ratio is from about 0.6:1 to about 2:1.

3. The composition of claim 1 wherein said mole ratio is from about 0.8:1 to about 1.5:1.

4. The composition of claim 1 wherein the composition contains from about 0.1 to 3% by weight of the at least one base-catalyzed reaction product.

5. The composition of claim 1 wherein component A) in said reaction product is epichlorohydrin.

6. The composition of claim 1 wherein in formula II in said reaction product n is a number of from 1 to 100.

7. The composition of claim 6 wherein n is a number of from 2 to 20.

8. The composition of claim 1 wherein in component B) in said reaction product the $R^2$ group is a straight or branched chain alkyl group.

9. The composition of claim 7 wherein in component B) n is a number from 2 to 20.

10. The composition of claim 1 wherein component B) in said reaction product has the formula:

$$R^2O(EO)_m(PO)_p(BO)_qH \quad \text{(III)}$$

wherein $R^2$ has the meaning given in claim 1, m is a number of from 0 to 100, p is a number of from 0 to 50, and q is a number of from 0 to 50.

11. The composition of claim 10 wherein component A) in said reaction product is epichlorohydrin.

12. The composition of claim 10 wherein the mole ratio of component A) to component B) is from about 0.1:1 to about 5:1.

13. The composition of claim 12 wherein said mole ratio is from about 0.8:1 to about 2:1.

14. The composition of claim 12 wherein said mole ratio is from about 1.0:1 to about 1.5:1.

15. The composition of claim 10 wherein m is a number of from 2 to 20.

16. The composition of claim 15 wherein p and q=0.

17. The composition of claim 10 wherein $R^2$ is an alkyl group having from 4 to 12 carbon atoms.

18. The composition of claim 17 wherein $R^2$ is a branched alkyl group.

19. The composition of claim 10 wherein $R^2$ is an alkyl group having from 4 to 12 carbon atoms, m is a number of from 4 to 50, and p and q=0.

20. The composition of claim 19 wherein component B) is isodecyl alcohol·4EO.

21. An aqueous paper coating composition comprising

I) at least one of a clay, a starch, casein, a resin, and a wax; and

II) at least one base-catalyzed branched reaction product comprising the following reactants:

A) at least one compound of formula I $$R^1(X)_3 \quad (I)$$

wherein each X group is a halogen atom or one X group is a halogen atom and two X groups represent an epoxy oxygen atom, which is attached to two adjacent carbon atoms in the $R^1$ group to form an epoxy group, and $R^1$ is an alkanetriyl group containing from 3 to 10 carbon atoms; and B) at least one compound having the formula II $$R^2X(AO)_nY \quad (II)$$

wherein $R^2$ is a substituted or unsubstituted, saturated or unsaturated, organic group having from 1 to 36 carbon atoms; X is —O—, —S—, or —$NR^3$— where $R^3$ is hydrogen or a $C_1$–$C_{18}$ alkyl group; each AO group is independently an ethyleneoxy, 1,2-propyleneoxy, or 1,2-butyleneoxy group, n is a number from 0 to 200; and Y is hydrogen, or Y can be a mercapto group or an amino group (amino or $C_1$–$C_6$ alkylamino group) in place of a terminal —OH group, provided that when Y is mercapto or an amino group, n is at least 1;

wherein the mole ratio of the linking compound A) to B) is from 0.1:1 to 5:1.

22. The composition of claim 21 wherein component I) comprises a clay, a starch, and a resin.

23. The composition of claim 21 wherein said mole ratio is from about 0.6:1 to about 2:1.

24. The composition of claim 21 wherein said mole ratio is from about 0.8:1 to about 1.5:1.

25. The composition of claim 21 wherein the composition contains from about 0.1 to 3% by weight of the at least one base-catalyzed branched reaction product.

26. The composition of claim 21 wherein component A) in said reaction product is epichlorohydrin.

27. The composition of claim 21 wherein in formula II in said reaction product n is a number of from 1 to 100.

28. The composition of claim 27 wherein n is a number of from 2 to 20.

29. The composition of claim 21 wherein in component B) in said reaction product the $R^2$ group is a straight or branched chain alkyl group.

30. The composition of claim 28 wherein in component B) n is a number from 2 to 20.

31. The composition of claim 1 wherein component B) in said reaction product has the formula:

$$R^2(EO)_m(PO)_p(BO)_qH \quad (III)$$

wherein $R^2$ has the meaning given in claim 1, m is a number of from 0 to 100, p is a number of from 0 to 50, and q is a number of from 0 to 50.

32. The composition of claim 31 wherein component A) in said reaction product is epichlorohydrin.

33. The composition of claim 31 wherein the mole ratio of component A) to component B) is from about 0.1:1 to about 5:1.

34. The composition of claim 33 wherein said mole ratio is from about 0.8:1 to about 2:1.

35. The composition of claim 33 wherein said mole ratio is from about 1.0:1 to about 1.5:1.

36. The composition of claim 31 wherein m is a number of from 2 to 20.

37. The composition of claim 36 wherein p and q=0.

38. The composition of claim 31 wherein $R^2$ is an alkyl group having from 4 to 12 carbon atoms.

39. The composition of claim 38 wherein $R^2$ is a branched alkyl group.

40. The composition of claim 31 wherein $R^2$ is an alkyl group having from 4 to 12 carbon atoms, m is a number of from 4 to 50, and p and q=0.

41. The composition of claim 40 wherein component B) is isodecyl alcohol·4EO.

* * * * *